United States Patent [19]

Cooper

[11] Patent Number: 5,008,644

[45] Date of Patent: Apr. 16, 1991

[54] TERMINAL ASSEMBLY FOR LINEAR MAGNETIC COMPONENT BOBBIN

[75] Inventor: Robert C. Cooper, Newton, N.H.

[73] Assignee: AT&T Bell Laboratories, Murray Hill, N.J.

[21] Appl. No.: 401,275

[22] Filed: Aug. 31, 1989

[51] Int. Cl.[5] ..... H01F 15/10; H01F 27/30

[52] U.S. Cl. ..... 336/192; 336/65; 336/208

[58] Field of Search ..... 336/192, 198, 208, 65; 310/71, 234

[56] References Cited

U.S. PATENT DOCUMENTS

| | | | |
|---|---|---|---|
| 2,194,502 | 3/1940 | Hower | 336/192 X |
| 2,648,031 | 8/1953 | Lang et al. | 336/192 X |
| 2,889,497 | 6/1959 | Wolf et al. | 336/192 X |
| 4,105,985 | 8/1978 | Plunkett | 336/192 X |

FOREIGN PATENT DOCUMENTS

| | | | |
|---|---|---|---|
| 1226209 | 6/1966 | Fed. Rep. of Germany | 336/192 |
| 2602834 | 7/1977 | Fed. Rep. of Germany | 336/192 |

*Primary Examiner*—Thomas J. Kozma
*Attorney, Agent, or Firm*—A. G. Steinmetz

[57] ABSTRACT

A new physical construction for attaching a phosphor bronze terminal to a plastic bobbin assembly permits a lower component height and a reduced footprint size as well as providing improved positive mechanical locking of the bobbin pinouts to the bobbin. This mechanical locking is provided by bending the attached end of the phosphor bronze terminal by 90 degrees and inserting the terminal into the bobbin so that the inserted part of the terminal is inserted horizontally into the support member of the bobbin. In this new configuration the bent end embedded in the bobbin is parallel to the printed circuit board surface on which the bobbin is mounted preventing the phosphor bronze terminal from working loose due to vibration and motion in the vertical axis direction.

4 Claims, 2 Drawing Sheets

TERMINAL ASSEMBLY FOR LINEAR MAGNETIC COMPONENT BOBBIN

FIELD OF THE INVENTION

This invention relates to bobbin structures for magnetic components and in particular to a terminal assembly for a bobbin.

BACKGROUND OF THE INVENTION

Conventional bobbin terminals or pinouts are typically inserted into the underside of bobbin flange supports with the terminals remaining unformed. Only friction holds the bobbin terminals in their sockets. Bobbin terminals of board mounted magnetic components, that are inserted in the bobbin in this manner, have a tendency to pull out of the bobbin. A typical arrangement is shown in FIG. 1 wherein the terminal 101 is inserted into a bobbin flange or mounting support member 102. The winding 103 of the bobbin is terminated by being wire-wrapped 104 about the terminal 101. The wire termination as wound has a vertical axis and in some applications may result in the magnetic component having a greater component height than is desirable. It is readily apparent that this arrangement permits the terminals to work their way out of the socket.

Terminals have been formed with a bend in the terminal to secure the terminals into the bobbin as shown in FIG. 2. In this particular arrangement the terminal 201 is inserted into the topside of the bobbin support member 202. As is apparent however the forming of the terminal 201 still does not prevent the terminal 201 from working out of the support member 202 due to forces perpendicular to the planar surface of the printed circuit board on which it will be mounted.

The winding 203 of the bobbin is, as shown, wound with a vertical axis and is terminated by being wound about the formed portion of the terminal 201 which is horizontal to the printed circuit board. Since the winding is attached externally to the terminal and beyond the perimeter of the bobbin support member 202, printed circuit board area is consumed unnecessarily.

SUMMARY OF THE INVENTION

Therefore, in accord with the invention, a new arrangement for attaching terminals to the bobbins of board mounted magnetic components reduces the amount of board real estate required for the component and increases the integrity of the terminal attachment to the bobbin.

A new physical construction for attaching a phosphor bronze terminal to a plastic bobbin assembly permits a lower component height and a reduced footprint size as well as providing improved positive mechanical locking of the terminals to the bobbin. This mechanical locking is provided by the insertion of the attached end of the phosphor bronze terminal horizontally into the molded bobbin support member after which the terminal is formed by 90 degrees. The vertical member of the terminal is captured by slots provided in the outer surface of the bobbin. Support members, in addition, prevent lateral movement of the terminal. In this new configuration the formed end, inserted into the bobbin, is parallel to the printed circuit board surface, on which the bobbin is mounted, preventing the phosphor bronze terminal from working loose due to vibration and motion in the vertical axis direction.

DETAILED DESCRIPTION

Figure 1:
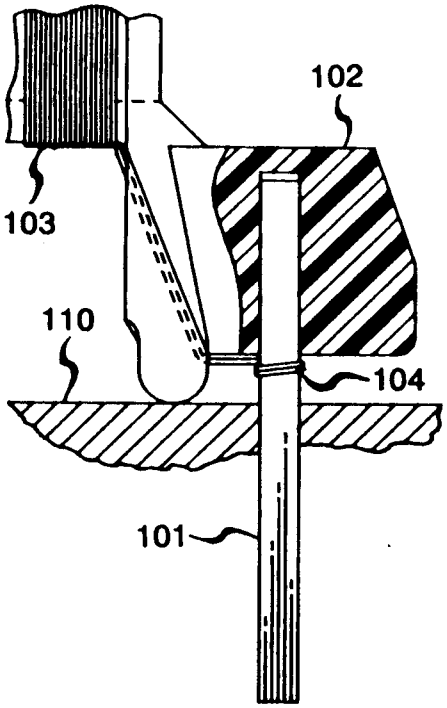
FIG. 1 (PRIOR ART)
FIG. 1 is a view of a pin mounted into a bobbin support member according to the prior art.

A terminal mounting arrangement according to the prior art arrangement is shown in FIG. 1. This terminal 101 is unformed and is inserted vertically into a vertical blind aperture of the support member 102 of a bobbin structure. A wire termination 104 of winding 103 is wound about the terminal 101. It is easily recognizable that in this arrangement the terminal 101 is very susceptible to being worked out of the terminal aperture by vertical forces. The terminal 101 is subject to being pulled from the bobbin while the leads are undergoing any number of manufacturing processes, i.e., soldering, crimping to the board 110, etc.

Figure 2:
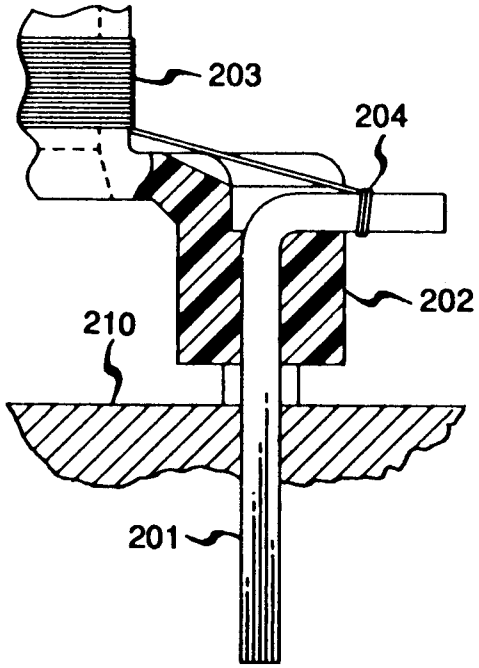
FIG. 2 (PRIOR ART)
FIG. 2 is a view of a pin mounted into a bobbin support member according to the prior art.

An alternative terminal mounting arrangement of the prior art shown in FIG. 2 utilizes an L shaped terminal 201 having its short arm formed over the top rim of the bobbin support member aperture. This arrangement provides the inserted terminal with resistance to downward vertical forces although it is still susceptible to being worked out of the aperture by upwardly directed vertical forces due to machine insertion, soldering and/or crimping operations.

The entire wire termination 204 of winding 203 is outside the perimeter of the base support member 202 of the bobbin and hence increases the amount of board space required by this bobbin assembly.

Figure 3:
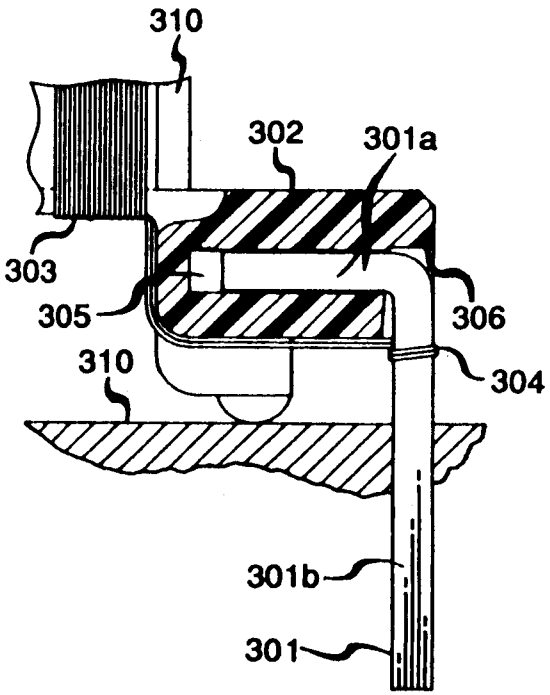
FIG. 3 is a view of a pin mounted therein in accord with the principles of the invention.

A new terminal assembly, embodying the principles of the invention and shown in FIG. 3, has a terminal aperture 305 that is parallel to the surface of the printed wiring board 310 on which the bobbin structure 311 is to be mounted. The terminal 301 has an L shape with the shorter leg of the pin inserted into the horizontal aperture 305. The shorter leg of the terminal **301*a* is preferably at a right angle with the longer leg 302*b*** of the terminal.

This aperture 305 is undercut under a shoulder 306 of the support member 302 of the bobbin so that the vertical leg **301*b* of the terminal 301 is under the shoulder 306 and does not extend horizontally beyond the perimeter of the bobbin support member 302. The wire termination 304 of the terminal end of winding 303 is wound around the vertical portion of terminal 301** and hence doe not require extra mounting space on the printed board on which the bobbin is mounted. Hence the required footprint of the bobbin structure is reduced to a minimum value.

The insertion of the terminal 301 into a horizontal 305 aperture of the bobbin support member 302 provides a mechanical locking arrangement for the terminal that is very resistant to forces vertical to the surface of board 310. Hence the bobbin terminal is unlikely to work loose from the bobbin support member 302.

A phosphor bronze terminal is utilized for terminal 301 in the illustrative embodiment. The winding 303 may be polyurethane coated copper wire as small as 43 gauge and the bobbin may be plastic. These component constituents are disclosed for illustrative purposes and the substitution of other materials will be readily apparent to those skilled in the art.

Figure 4:
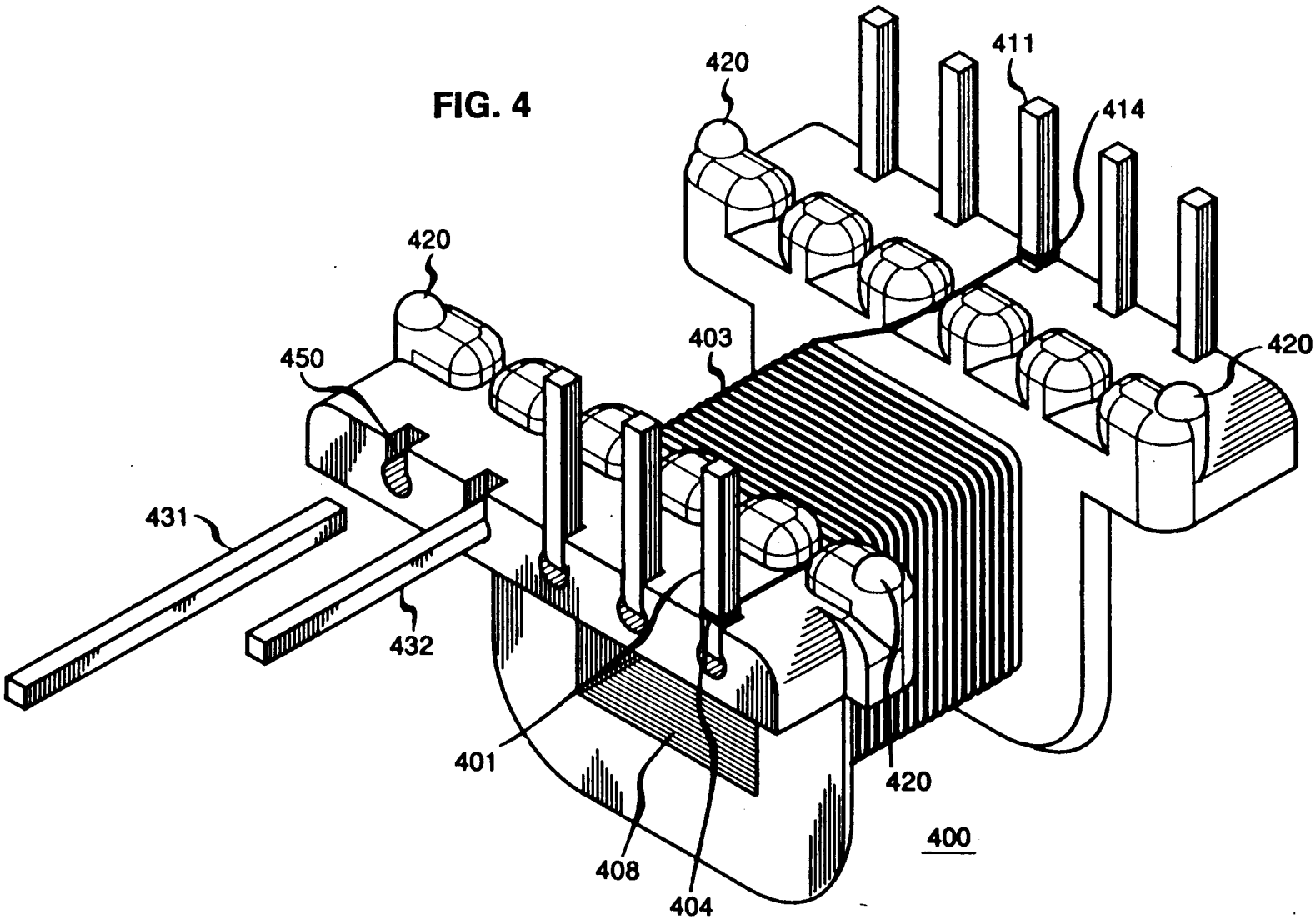
FIG. 4 is a pictorial view of a bobbin having pins mounted therein in accord with the principles of the invention.

A pictorial view of an overall bobbin structure 400, embodying the principles of the invention, is shown in FIG. 4. A winding 403 is wound about a central winding member 408 with wire terminations 404 and 414 wound about two terminals 401 and 411 respectively. The terminals are, as shown by terminals 431 and 432, inserted horizontally into the bobbin structure 400 and then formed with a right angle bend so that the terminals may be inserted into terminal receptacle of a printed circuit board on which the bobbin is mounted. Slots 450 in the bobbin provide mechanical support for the formal terminals.

This bobbin structure 400 is mounted on a printed circuit board with the terminals secured into pin hole receptacles of a printed circuit board. The bobbin structure 400 includes supporting standoffs 420 which rest on the surface of the printed circuit board and provide support for the bobbin. In this arrangement the winding terminations 404 and 414 advantageously do not require any added board mounting space as is required with the prior art arrangement of FIG. 2.

I claim:

1. An assembly for a magnetic component comprising:

a bobbin structure including:

mounting supports having a plurality of supporting standoffs for resting on a planar surface on which the bobbin structure is to be mounted a winding wound about a portion of the bobbin structure with a winding axis parallel to the planar surface and having at least one wire termination lead connected to the winding, at least a terminal integral to the bobbin being included in the mounting support of the bobbin structure having an L shape and included in a passageway in the mounting support of the bobbin structure and having a longitudinal axis parallel to the planar surface with a first leg of the L shaped terminal substantially parallel to the planar surface and a second leg of the L shaped terminal substantially perpendicular to the planar surface and the termination end of the winding wound about the second leg of the terminal, the wire termination being passed between two adjacent standoffs to a wound portion of the winding on the bobbin structure, and the standoffs having a sufficient dimension perpendicular to the planar surface to prevent contact between the termination end of the winding wound on the second leg and the planar surface.

2. An assembly for a magnetic component as defined in claim 1:

wherein the passageway is undercut so that the second leg of the terminal and its wire termination is under the mounting support member of the bobbin and within boundaries of a footprint of the magnetic component.

3. A bobbin and winding structure for a magnetic component, comprising:

a winding structure accepting a winding, first and second support members attached to opposing sides of the winding structure and each support member including a plurality of supporting standoffs adapted for supporting the bobbin structure on a planar surface, each support member including a passageway for accepting a mounting terminal, the passageway having its longitudinal axis substantially parallel to the planar surface when the bobbin structure is mounted on the planar surface, at least one terminal associated with each support member, each terminal having a first and second leg at right angles to each other, the first leg of each terminal inserted into the passageway of its associated support member, the second leg of each terminal having an attached wire termination of a terminal end of the winding the wire termination for each terminal being passed between two adjacent standoffs to a wound portion of the winding on the bobbin structure, and the standoffs having a sufficient dimension perpendicular to the planar surface to prevent contact between the termination end of the winding wound on the second leg and the planar surface.

4. A bobbin and winding structure as claimed in claim 3, wherein:

the bobbin structure has a defined footprint on the planar surface on which it is mounted and the passageway is undercut so that the terminal and its associated wire termination is within the confines of the defined footprint.

* * * * *